US005282286A

United States Patent [19]

MacLeish

[11] Patent Number: 5,282,286

[45] Date of Patent: Feb. 1, 1994

[54] SEALED COMPOSITE CUSHION HAVING MULTIPLE INDENTATION FORCE DEFLECTION ZONES

[75] Inventor: Michael MacLeish, Seattle, Wash.

[73] Assignee: Cascade Designs, Inc., Seattle, Wash.

[21] Appl. No.: 977,136

[22] Filed: Nov. 16, 1992

[51] Int. Cl.[5] ..... A47C 27/14

[52] U.S. Cl. ..... 5/654; 5/464; 5/471; 5/481; 297/459

[58] Field of Search ..... 5/464, 471, 481, 653, 5/654, 450; 297/458, 459

[56] References Cited

U.S. PATENT DOCUMENTS

| | | | |
|---|---|---|---|
| 3,605,145 | 9/1971 | Graebe | 5/348 |
| 3,616,471 | 11/1971 | Braun | 5/348 |
| 3,846,857 | 11/1974 | Weinstock | 5/345 |
| 3,987,507 | 10/1976 | Hall | 5/464 X |
| 4,025,974 | 5/1977 | Lea et al. | 5/367 |
| 4,073,021 | 2/1978 | Carlisle | 5/365 |
| 4,086,675 | 5/1978 | Talbert et al. | 5/355 |
| 4,132,228 | 1/1979 | Green | 128/33 |
| 4,522,447 | 6/1985 | Snyder et al. | 297/452 |
| 4,753,480 | 6/1988 | Morell | 297/452 |
| 4,930,171 | 6/1990 | Frantz | 5/450 |
| 4,951,334 | 8/1990 | Maier | 297/459 X |
| 5,117,517 | 6/1992 | Su | 5/450 |
| 5,144,705 | 9/1992 | Rogers | 5/654 X |

*Primary Examiner*—Michael F. Trettel

*Attorney, Agent, or Firm*—David L. Garrison; Stephen M. Evans

[57] ABSTRACT

A sealable, composite cushion is disclosed having a plurality of resilient support member horizontally disposed to one another and surrounded by a fluid impervious membrane. Each resilient support member has a known Indentation Force Deflection (IFD) value and is located in the cushion based upon medical criteria to provide zones of varying support. In an embodiment, the resilient members are bonded to the membrane and act as tension members to maintain the cushion's form while under a load. As a result, the cushion resists further deflection not only by the resilient members' resistance to compression, but also by an increased internal pressure. Accordingly, the cushion of the present invention is a composite of fluid flotation and compression resistance. A valve may be incorporated into the cushion to regulate the fluid floatation characteristics of the cushion or to assist in its transportation. In another embodiment, the resilient support members are not bonded to an upper membrane portion, thereby decreasing shear forces acting upon the resilient members when the cushion is under load. Further, excess membrane may be located at the cushion periphery. When subject to a load, this excess membrane material can migrate to the upper portion of the cushion, thereby decreasing undesirable peripheral distortion of the cushion.

15 Claims, 4 Drawing Sheets

FIG. 1
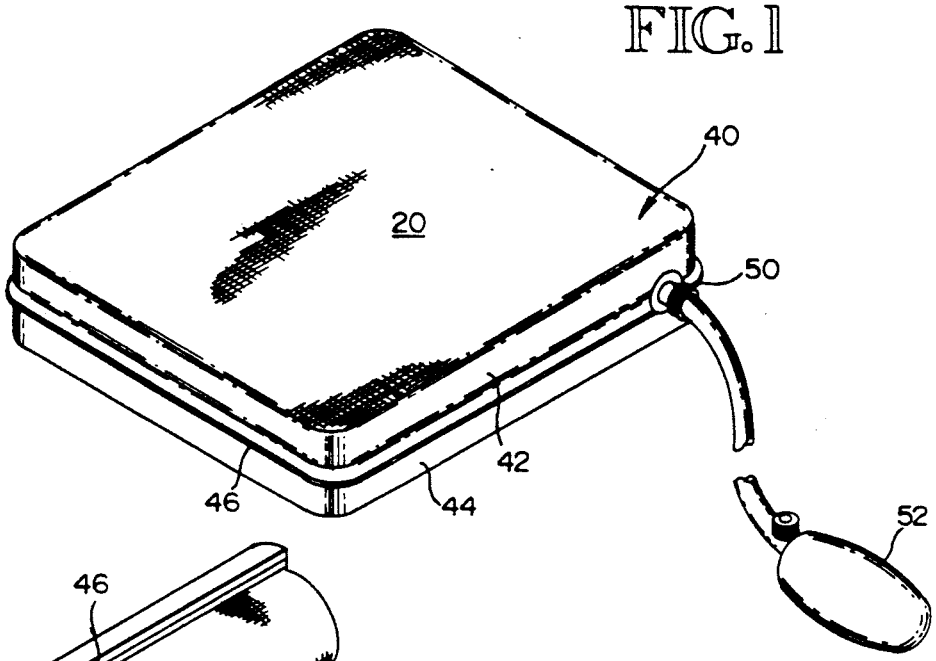
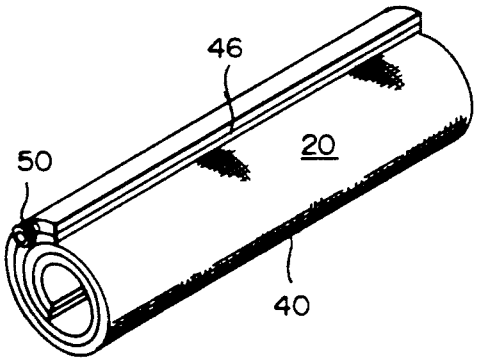
FIG. 1A
FIG. 2
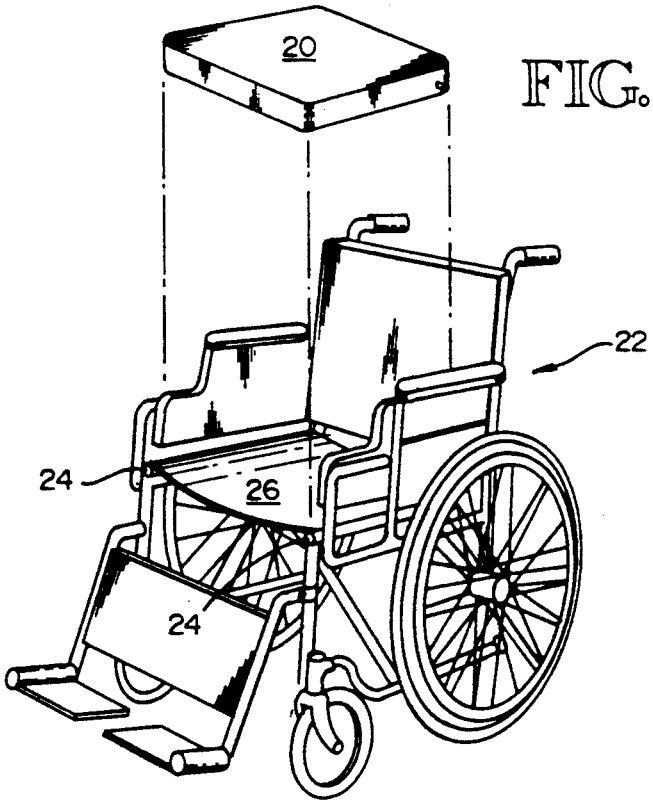

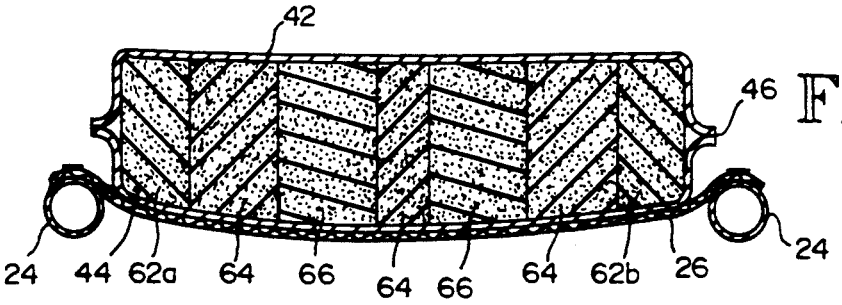
FIG. 4
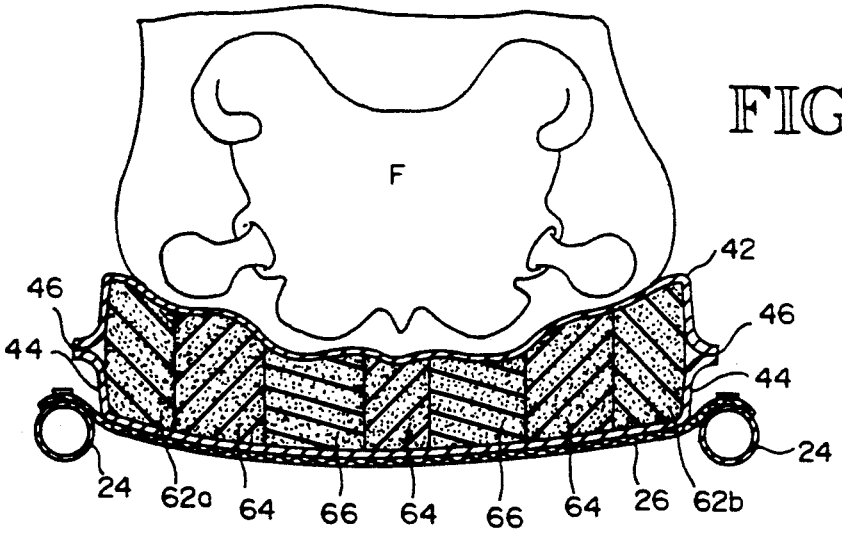
FIG. 5
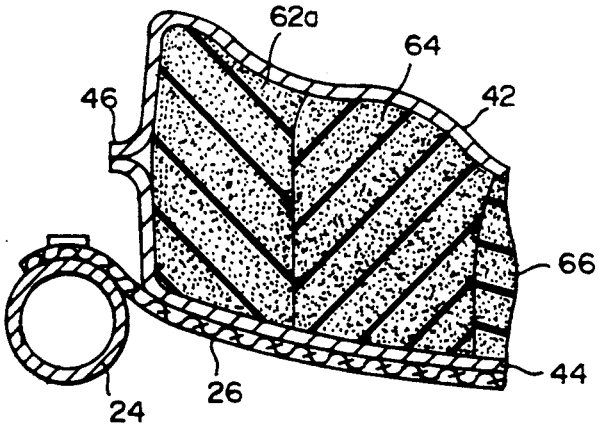
FIG. 7
FIG. 6
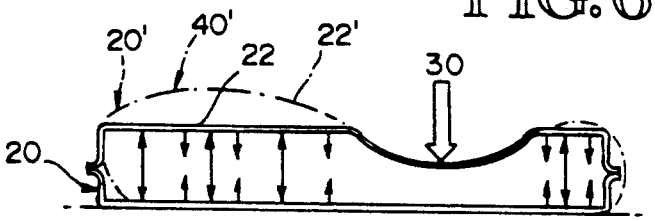

SEALED COMPOSITE CUSHION HAVING MULTIPLE INDENTATION FORCE DEFLECTION ZONES

FIELD OF THE INVENTION

The invention relates to the field of cushions and more particularly to cushions for use with wheelchairs. By integrating selectively placed foam elements having varying properties within a fluid floatation system, a sealed cushion is formed that provides improved health, comfort, and support to mobility impaired persons.

BACKGROUND OF THE INVENTION

Persons who must spend long periods of time in one position, whether sifting or lying, often experience tissue injury and discomfort because the interaction between the supporting structure and the area of the person being supported often produces pressure sores and related conditions. Persons in wheelchairs are especially susceptible to the formation of pressure sores and the related tissue injury and discomfort they cause. Typically, persons who use wheelchairs have more of the factors that are considered to promote formation of pressure sores, e.g. age, activity levels (either very active or inactive), general health, weight, etc. Therefore, a need exists to modify the physical attributes of the supporting device that cause pressure sores to form in the first place.

To better understand the need for the present invention, an analysis of the likely causes of tissue injury is necessary. Pressure sores and related degenerative conditions result from an ulceration of the skin and/or deeper tissue due to unrelieved pressure, shear forces, and/or frictional forces. This condition occurs most frequently in persons confined to a bed or a wheelchair for long periods of time. The onset of these ulcers is believed to be triggered by a hypoxia condition—the decrease flow of or lack of oxygen to the subject tissue. As a consequence of this diminished oxygen supply to hard and soft tissue sites, aerobic and/or anaerobic microorganisms and their waste products can accumulate in these areas and cause infection and bacteremia leading to increased tissue breakdown and decreased healing abilities. Research has shown that healing wounds had absolutely no anaerobic bacteria and that few colonies and types of aerobic bacteria were present. Nonhealing wounds, however, had very high counts of both aerobic and anaerobic bacteria. Consequently, hypoxia of tissue subject to pressure not only is the likely cause of pressure sores, but also interferes with the natural healing process.

Because the number of persons who lack full mobility has increased as the median age of the population has increased, there is a greater number of mobility impaired persons using wheelchairs or spending considerable time in bed. Until recently, little attention had been given to modifying the supporting devices used by these people. Now, the combination of a greater segment of the population using or confined to these devices, and an increased understanding of the causes and effects of pressure sores, has created a need for products to make these supporting devices more comfortable and therapeutic. Ideally, these products alleviate pressure sore formation, increase user comfort, and enhance body support and position.

In the art to which this invention is directed, comfort is associated with reduction of pressure in critical areas.

The less pressure in critical areas, the greater the comfort and the fewer number of pressure sores. Because pressure occurring at any given point on a person's body is a result of the force, i.e. the weight acting on the person per unit area affected, the goal is to increase the area subject to this force, thereby decreasing effective localized pressure. Therefore, the ideal cushion would have a custom base molded to the user to maximize comfort while enhancing support. Ideally, the user would never shift his or her position nor change his or her physical attributes. Of course, such conditions and restraints are not practical. Hence, a cushion must be adaptable to various sitting positions that might occur through normal use and weight shifting, and be adaptable to changes in the person's physical attributes. To meet these needs, a variety of seat cushions have been proposed and used.

In the field of wheelchair cushions, four types of cushions predominate: foam devices, viscoelastic foam devices, gel devices, and fluid flotation devices. Research has shown that in addition to the discomfort and health risk associated with pressure sores, a person's comfort when using a cushion type device is also affected by poor distribution of stresses, moisture accumulation, heat transfer (either excess accumulation or loss), and stability. Research has also shown that the efficacy of the cushion (i.e. its support) includes such parameters as stability, weight of the cushion, frictional properties, thickness of the cushion, cost, and durability. Each type of cushion has its advantages and disadvantages. Some cushions distribute pressure very well but do so at the cost of excess heat transfer, moisture accumulation, or weight. Other cushions provide low humidities due to their porous properties but do not allow heat to flow freely from a person's skin, thus increasing perspiration and decreasing comfort. Still other cushions are light and easy to transport but do not offer an effective support in areas.

While each type of cushion has successfully been used to mitigate specific instances of the formation of pressure sores, recent advances in foam technology has made foam type cushion, a cost verses performance leader. When discussing foam type cushions, two measurements are primarily used: Indentation Force Deflection (IFD) and foam modulus. IFD values are measured by taking a 15"×15"×4" foam sample and measuring the force needed to cause a 25% reduction in foam thickness by depressing an eight inch diameter disk therein. For example, an IFD value of 40 pounds means that a force of 40 pounds is required to depress the eight inch diameter disk, having an area of approximately 50 $in^2$, one inch into the foam sample. Modulus is defined as the IFD at 65% of the sample thickness divided by the IFD at 25% of the sample thickness. These two methods for determining the characteristics of a foam sample provide the best measure for determining what type of foam should be used for a particular application.

Traditionally, foam type cushions of the prior art comprised a single section of foam. The foam may or may not have been contoured and may or may not have had a cover. More recent cushions have incorporated multiple sections of foam. These cushions essentially stacked sections of foam, with or without inserts, upon one another to achieve a cushion having varying properties.

SUMMARY OF THE INVENTION

The present invention comprises one or a plurality of resilient support elements surrounded by a fluid impermeable membrane to provide a support surface having known Indentation Force Deflection (IFD) values and zones. A load placed over the surface of the cushion is supported by the one or plurality of resilient support elements and by fluid contained within the membrane. In so doing, both of the advantages inherent with resilient and fluid support devices are maximized. Moreover, the fluid impermeable membrane extends the useful life of the cushion because exposed resilient cushions, i.e. foam cushions, have an inherently limited field life.

In a preferred embodiment, a plurality of foam support elements are horizontally disposed relative to each other in the cushion and are constructed from foam materials having differing IFD values. Location of each of the plurality of foam elements is determined by the anticipated load conditions for that area of the cushion and the IFD value of the various foams best able to meet those needs. Additional consideration may given to proper skeletal support needs.

Each foam element is located adjacent to at least one other foam element. The plurality of foam elements are assembled within the cushion in zones so that for each zone, the IFD value of the cushion is known and may be predesigned for the necessary support. In this manner, precise control over the cushion's load bearing characteristics can be maintained.

To ensure that the foam elements do not appreciably shift from their desired location either during manufacture of the cushion or during use, a preferred embodiment permits the foam elements to be attached to one another and/or attached to the internal surface of the fluid impermeable membrane either on the top surface, the bottom surface, or both surfaces. A feature of a cushion having both the upper and lower surface of the membrane attached to the foam is that the foam acts as a tensioning member, thereby preventing significant physical distortion of the cushion while subject to a load. Consequently, a deflection of the cushion at a loaded area will not result in a corresponding bulge in another area—such bulges causing an increase in relative pressure against a person using the cushion. Moreover, because the membrane is prevented from appreciably extending to form a bulge, internal pressure is increased when the cushion is deflected thereby providing increased resistance to further deflection. This aspect beneficially provides for a progressive resistance to deflection, independent of the IFD properties of the foam elements.

In addition, the invention provides for various membrane compositions. More particularly, a non-stretching membrane may be bonded to one or more of the plurality of foam elements to provide a controlled transition between the varying types of foam, element and to decrease the shear forces encountered by the foam elements when deflected during loading of the cushion so as to increase lateral stability. A stretchable membrane may be used to increase the desirable effects of fluid floatation and increase the transition areas between the plurality of foam element. Both types of membranes are preferably constructed from a durable, water repellent material which also protects the foam from the environment.

In applications where active pressurization of the cushion is used, voids in the foam structures may be incorporated. This feature permits those areas to support a load predominantly by means of fluid floatation. Active pressurization of the cushion also permits customizing the load bearing characteristics of the cushion to accommodate users of various weights and to a lesser extent, can vary the relative support heights.

The present invention also provides additional methods for customizing the cushion's load bearing characteristics. Composite foam sections and foam sections of varying thickness can be utilized to provide additional flexibility when designing the cushion. In such an embodiment, both comfort and support aspects can be conveniently altered. Alternatively, portions of a foam element can be carved out to reduce the sectional thickness of the element. Either method provides a convenient means to further control the support characteristics of the cushion.

To further enhance the stability and conformability of the cushion, an alternative embodiment of the invention does not attach the foam at the vertical periphery of the cushion to the fluid impermeable membrane, or have it compressed by same prior to the cushion's loading. This configuration advantageously permits a greater portion of the foam material to deflect on the upper surface thereby maximizing the area of support and relieving shear forces between the foam and the membrane.

Stability is further enhanced by another embodiment wherein the foam at the vertical periphery is uncompressed when the cushion is not in use. By keeping the foam uncompressed throughout the cushion, no portion of the cushion is unusable for support.

The combination of foam and fluid cushioning also permits the present invention to be conveniently stored when not in use. By opening a valve that is in fluid communication with the sealed enclosure defined by the membrane, fluid, e.g. air, can be removed from the cushion, permitting a user to collapse the cushion into a size which is convenient for storage. By closing the valve after removal of the air, the cushion will retain its collapsed form. When it is desired to use the cushion, the valve is opened and fluid is allowed to enter. Because the foam has a natural tendency to expand, a low pressure area forms in the void defined by the membrane which causes the cushion to self-inflate. By choosing various IFD value foams, the rate of self-inflation can also be controlled.

The various aspects of the present invention as described above are exemplified in the Drawings and Detailed Description of the Invention which follows:

BRIEF DESCRIPTION OF THE DRAWINGS

FIG. 1 is a perspective view of a seat cushion embodiment of the invention;

FIG. 1A is a perspective view of the seat cushion embodiment shown in a collapsed form to facilitate storage or transportation;

FIG. 2 is a perspective view of the seat cushion shown in FIG. 1 and its placement in a conventional wheelchair;

FIG. 4 is a cross sectional view taken substantially along the line 4—4 in FIG. 3A of the seat cushion positioned on a wheelchair seat in an unloaded condition;

FIG. 5 shows the cushion of FIG. 4 subject to the load imparted by a human buttocks positioned upon the cushion the buttocks being shown as a partial silhouette to emphasize the location of hard tissue;

FIG. 6 is a cross sectional view of an embodiment of the invention wherein the foam elements are bonded to the membrane and a non-attached membrane is superimposed thereon with both cushions subjected to a load;

FIG. 7 is an enlarged partial cross sectional view taken substantially along the line 4—4 of FIG. 3A wherein the foam elements are bonded to the membrane to cause a graduated transition between support zones when the cushion is subject to a load;

DETAILED DESCRIPTION OF THE INVENTION

Figure 3:
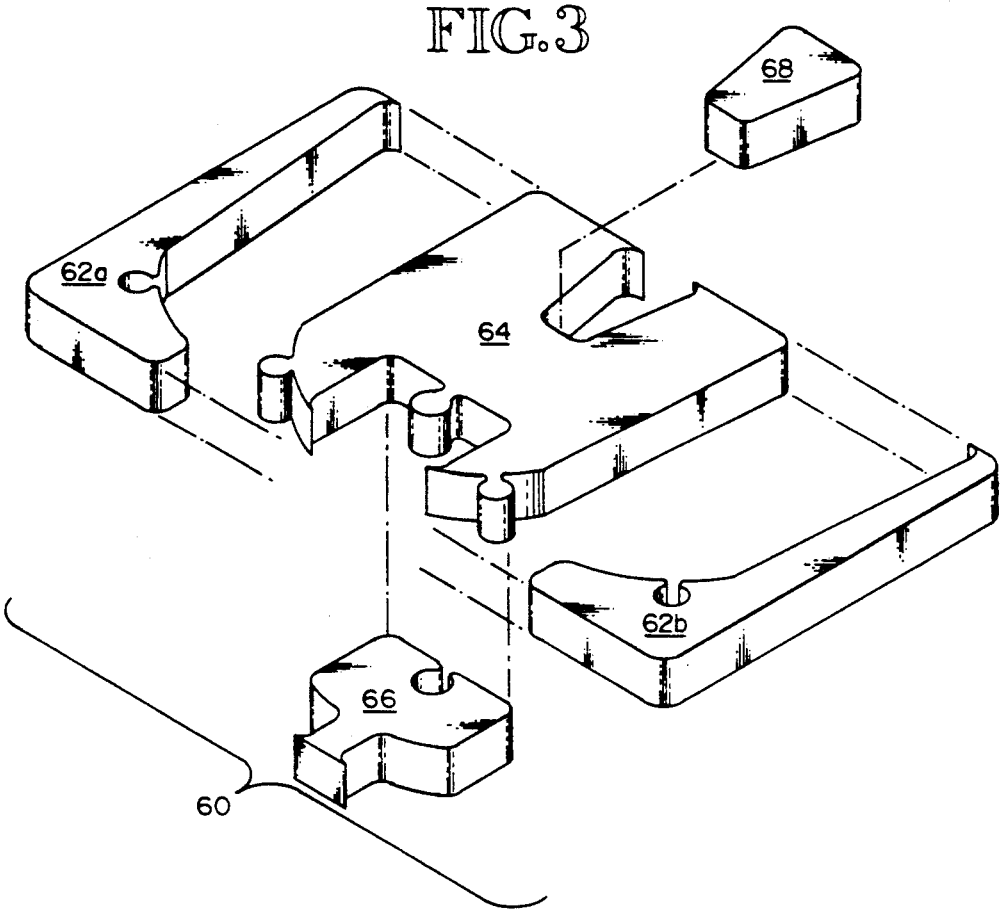
FIG. 3 is a perspective view of the foam elements of one embodiment of the invention shown in exploded form.

Turning now to the several Figures wherein like numerals indicate like parts, a perspective view of a preferred embodiment of the invention is shown in FIG. 1 and is designated as cushion 20. Cushion 20 has as an exterior membrane 40 which comprises upper membrane portion 42 and lower membrane portion 44 sealingly attached to one another at seam 46 so as to wholly enclose a plurality of foam elements 60 located therein. Membrane 40 is preferably constructed from a sheet of polyurethane coated fabric or its equivalent which is comprehensively described in U.S. Pat. No. 4,624,877 and is incorporated herein by reference. Also shown is valve 50 which provides adjustable fluid communication between the interior portion of cushion 20 and the environment. Thus, the internal volume of cushion 20 as defined by membrane 40 may be actively or passively inflated or deflated by use of valve 50. Moreover, cushion 20 may be deflated for convenient transportation or storage as illustrated in FIG. 1A.

As shown in FIG. 2, cushion 20 can be designed to fit various wheelchair seat sizes. More specifically, the present invention is particularly adapted to provide pressure redistribution and predesigned body support for use upon sling seat 26 that is supported by rails 24 of a wheelchair 22. The various sizes of cushion 20 that have been constructed for use in a wheelchair 22 have dimensions ranging from 35.56–45.72 cm×40.64–45.72 cm. The height of cushion 20 is sufficient to accept an anticipated load thereon and in this embodiment, the height is approximately 8.26 cm. This height has been determined through experimentation to provide the optimal comfort/support verses weight/height ratio. Should design considerations indicate different dimensions, such dimensions are within the parameters of the invention as detailed below.

Figure 3A:
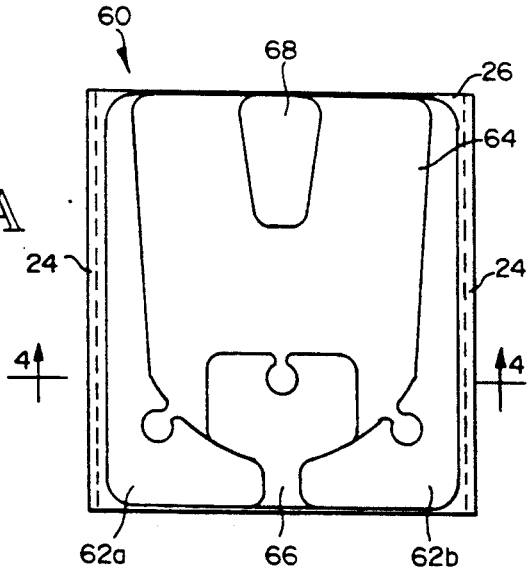
FIG. 3A is a plan view of the foam elements shown in FIG. 3 positioned in a wheelchair and having the membrane removed for clarity.

As best shown in FIG. 3, foam elements 60 comprise foam elements 62*a* and 62*b*, foam element 64, foam element 66, and foam element 68. Foam elements 60 can be frictionally or adhesively connected to one another to form the shape of cushion 20 as shown in FIG. 3A. By aligning each foam element comprising cushion 20 horizontally adjacent to at least one other foam element, great control can be exercised over the support and pressure redistribution aspects of the invention.

A feature of the invention is to use foam elements that have specific resiliency and load bearing characteristics depending upon anticipated loads and in light of medical criteria. Medical research has shown that the tissue proximate the ischial tuberosities of a person relegated to a wheelchair are particularly susceptible to the formation of pressure sores through hypoxia of that tissue intermediate the bony structures and the support surface. It is also known that other areas of the buttocks and thighs have a greater capacity to withstand a continuous load condition without forming pressure sores or ulcers. Hence, it is desirable to reduce the pressure in some areas, i.e. the areas associated with the ischial tuberosities and other bony protuberances, and redistribute that pressure to other areas. Moreover, if the pressure redistribution can also accomplish posture support, the person will be further aided by the supporting cushion. Consequently, foam elements 60 internal to cushion 20 are selected and appropriately located based in large part on the foregoing criteria.

The inventor has found that an optimum combination of support and pressure reduction to critical areas can be obtained by locating foam elements 62*a*, 62*b*, and 68 having an IFD value of about 50 pounds; foam element 64 having an IFD value of about 26 pounds; and foam element 66 having an IFD value of about 9 pounds in the positions shown in FIG. 3A. By orienting foam elements 60 so that they are homogenous throughout the vertical plane as shown in FIG. 4, zones of predetermined pressure bearing and redistributing properties can be created to support various areas of a seated person as exemplified in FIG. 5. As will be discussed below, these zones can be modified by changing the foam to membrane interface, or the characteristics of the membrane material, or the composition of the foam elements.

In addition to changing the foam to membrane interface to modify the different zones of support, the method of connecting the plurality of foam elements 60 can be changed to affect the support characteristics of cushion 20. In FIG. 3 and FIG. 3A, foam elements 60 are fictionally fit to one another thereby permitting each zone to compress essentially independently of an adjacent zone as shown in FIG. 5, assuming for the moment that membrane 40 is not bonded to foam elements 60. This configuration, however, does not provide a smooth transition from one zone to another. If foam elements 60 were bonded to one another, a more gradual transition between foam elements 60 would result. By incorporating combinations of the two described methods of connecting the plurality of foam elements 60, great control over the compressional characteristics of cushion 20 can exercised.

An equally effective method for easing the zone to zone difference is to change the foam to membrane interface properties. A feature of the invention provides for bonding one or more of the foam elements 60 to membrane 40: either upper membrane portion 42, lower membrane portion 44, or both. By changing the foam to membrane interface, various aspects of pressure redistribution and support can be changed. The following examples demonstrate the great control over pressure redistribution and support that can be achieved by changing the characteristics of the foam to membrane interface.

EXAMPLE 1

One embodiment of the invention has both upper membrane portion 42 and lower membrane portion 44 bonded to foam elements 60. In this embodiment, cushion 20 is allowed to reach equilibrium with its surrounding environment and valve 50 is then closed. A load placed on cushion 20 will cause the internal pressure of cushion 20 to increase. The increase in internal pressure, which beneficially acts to oppose further deflection of cushion 20 by loading, occurs because the upper surface of cushion 20 adhered to foam elements 60 cannot deflect upwardly. Thus, cushion 20 provides progressive resistance to increased loading by causing the internal pressure to increase in response thereto.

To better illustrate, attention is drawn to FIG. 6 wherein a cross section of cushion 20 in simplified form is shown. An air floatation cushion 20' is also shown which is initially of the same shape as cushion 20. When cushion 20 and cushion 20' are subject to a load 30, upper membrane portion 42 and 42' deflect inwardly causing a momentary increase in pressure as indicated by the long, double-headed arrows. For simplicity, only vertical forces are illustrated. Membrane 40' responds to this increased pressure by bulging outwardly where not restricted. Consequently, the internal pressure of cushion 20' remains relatively constant after membrane 40' reforms in response to load 30. Membrane 40, however, does not reform in response to load 30. Instead, foam elements 60 (not shown in this Figure) act as tensile or expansion restraining members as indicated by the short, single-headed arrows. Again, only vertical arrows are shown for simplicity. Because membrane 40 is prevented from bulging, internal pressure increases generally proportionately to load 30. Consequently, a progressive resistance to further deflection of membrane 40 is developed.

From the foregoing it can be seen that foam elements 60 not only resist compression loading in the traditional sense, but when bonded to membrane 40 prevent undesired membrane distortion which further enhances support. Thus, a cushion according to the present invention has increased load bearing capacities because it uses both foam compression and fluid floatation support, and prevents undesirable membrane bulging and lateral slip.

It is important to note, however, that this pressure resistance to loading is separate and distinct from foam elements 60 compression resistance to loading and transcends throughout cushion 20, regardless of IFD values. Moreover, while the IFD values of foam elements 60 cannot be changed during use of cushion 20, the effect of internal pressurization of cushion 20 can be so changed, the combination of the constant support provided by the foam and the variable support provided by the fluid being one of the primary desirable features of this invention.

In summary, each cushion 20 has certain inherent properties which are a function of the choice and placement of foam elements 60; and each cushion 20 can be custom tailored by the user via the degree of internal pressurization desired. For example, a heavier user of cushion 20 might desire additional resistance to deflection. By actively pressurizing cushion 20 with a pump (not shown) via valve 50, additional support and/or pressure redistribution can be conveniently obtained. Conversely, a lighter user can position his or her self upon cushion 20 and allow a certain amount of fluid or air to escape the cushion and then close valve 50 to provide the support desired, In effect, foam elements 60 are compressed by atmospheric pressure and a more contoured cushion having less thickness results.

EXAMPLE 2

Another feature associated with utilizing foam elements 60 bonded to membrane 40 is that a more gradual transition between the differing IFD value foams can be established. As best shown in FIG. 7, such bonding causes an increase in the foam-membrane shear forces when cushion 20 is subject to a load. These shear forces cause foam elements 60 to deflect in response to the imposition of a load. Consequently, there is a decrease in definition between the various IFD zones which decreases point loading at these locations. By incorporating this method of construction, a superior support and pressure reducing cushion can be made.

In addition to the foregoing, a simple manufacturing process can be used by bonding the various foam elements 60 to membrane 40. The manufacturing process used by the inventor comprises of locating foam elements 60 between upper membrane portion 42 and lower membrane portion 44 and sealing the membranes together as the peripheries thereof. By positively adhering or connecting elements 60 to either or both membrane portions by adhesives or the like, the chances of foam elements 60 moving during membrane sealing process is all but eliminated and the intended deflection and support parameters designed into the composite support pad of this invention assured in the manufacturing process.

EXAMPLE 3

Figure 8:
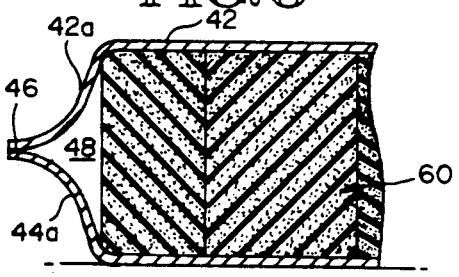
FIG. 8 is an enlarged partial cross sectional view of an embodiment of the invention which incorporates a relieved membrane periphery and un-bonded upper membrane to permit migration of the relieved membrane with respect to the upper portion of the cushion when subject to a load.
Figure 9:
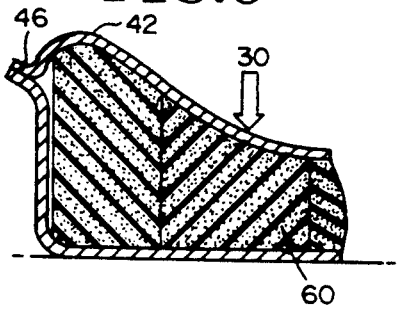
FIG. 9 shows the cushion of FIG. 8 subject to a load.
Figure 10:
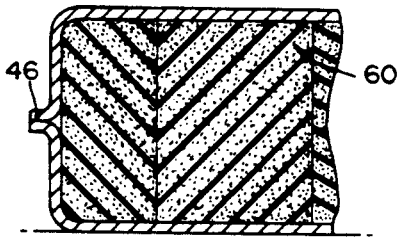
FIG. 10 is an enlarged partial cross sectional view of a cushion which does not incorporate a relieved membrane periphery and un-bonded upper membrane.
Figure 11:
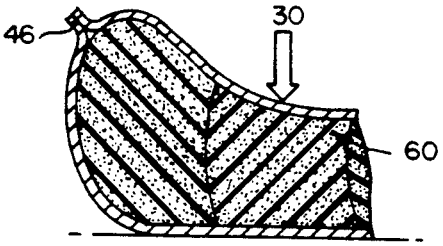
FIG. 11 shows the cushion of FIG. 10 subject to a load.

Turning to FIGS. 8 and 9, another novel feature of the invention and present in various embodiments is shown. By constructing cushion 20 so as to have extra upper and lower membrane material **42*a* and 44*a* adjacent seam 46 thereby forming void 48 (shown in an exaggerated state) more upper membrane material 42 is available to the upper surface of foam elements 60 upon loading of cushion 20. The importance of this feature is best illustrated in FIGS. 8 and 9, and FIGS. 1 0 and 1 1 wherein a cushion constructed according to this feature of the invention is shown without a load 30 in FIG. 8 and with a load 30 in FIG. 9, and a cushion constructed without this feature of this invention is shown without a load 30 in FIG. 10 and with a load 30 in FIG. 11. The ability of cushion 20 in FIG. 8 to collapse void 48 to obtain additional usable, upper membrane material 42 as shown in FIG. 9 effectively compensates the loss of horizontally disposed upper membrane material 42 that results from its deflection due to loading. Essentially, upper membrane material 42a migrates to the upper surface of foam elements 60. This migration causes void 48 to collapse and lower membrane material 44a to move adjacent to the vertical sidewalls of foam elements 60. The cushion 20 shown is FIGS. 10 and 11 deforms upon deflection by load 30, thereby increasing cushion distortion and shear forces which results in a possibly undesirable loss of the IFD zones. By incorporating void 48 foam elements 60** beneficially retain their distinct IFD zones. Those persons skilled in the art will appreciate that shear forces on the seating surface are significantly reduced by using this configuration.

It should be noted that this deflection compensation occurs primarily when upper membrane portion 42, which may or may not be constructed from stretchable material, is not bonded to foam elements 60, thereby permitting sliding of upper membrane portion 42 over foam elements 60. Consequently, positive pressurization of cushion 20 without having a person seated thereon is not recommended because membrane extension—bulges—will occur.

EXAMPLE 4

Figure 12:
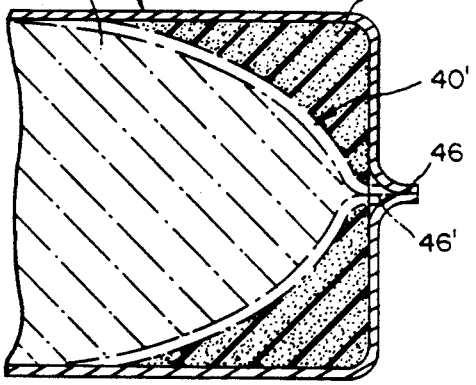
FIG. 12 is a greatly enlarged partial cross sectional view of an embodiment of the invention emphasizing an uncompressed peripheral foam area and a cushion having a compressed peripheral foam area shown in phantom.
Figure 13:
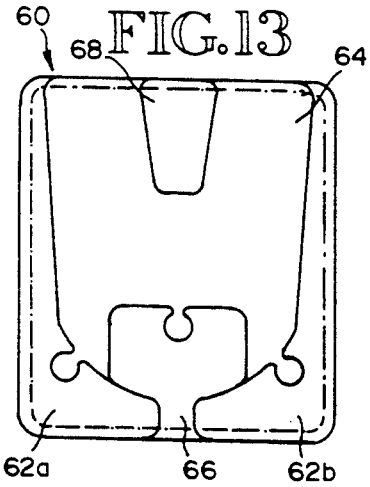
FIG. 13 is a plan view of the plurality of foam elements in a cushion having a compressed area between the dashed line and the outer periphery thereby offering decreased pressure relief and support to a load placed thereon.

Yet another novel feature of the invention also relates to the interface of membrane 40 with foam elements 60. In this embodiment of the invention as shown in FIG. 12, the foam elements 60 at vertical side periphery 52 of cushion 20 are not compressed during the manufacturing process while conventional construction of pads or cushions of the type popular in the prior art have a compressed vertical side periphery 52' near seam 46' as is shown in phantom. Consequently, any foam element 60 near seam 46 is uncompressed and functional for support, while any foam element 60' near seam 46', is not. While constructing cushions having a compressed periphery is quick and efficacious for relatively large and thin cushions, it is ill suited for relatively thick cushions having a small surface area. Because the seating surface of wheelchair cushions are limited and almost completely utilized, it is important that any cushion maximize this limited surface area. If a cushion employing the teachings of the prior art were used, a substantial portion of the periphery of the cushion would loose its effectiveness, i.e. it would be compressed. This fact is particularly important because a large portion of a cushion's posture supporting properties are associated with the periphery of the cushion. For example, in FIG. 13, the plan view of the plurality of foam elements 60 are again shown, but with the dashed line indicating the boundary between compressed and uncompressed foam elements. As this Figure demonstrates, much of foam element 62a and foam element 62b are precompressed by this type of manufacturing process, thus significantly affecting the cushion's ability to function as designed—especially regarding posture support. By manufacturing cushion 20 to have its vertical side periphery relieved and uncompressed, the limited surface area of cushion 20 is completely available for pressure redistribution and especially body support.

EXAMPLE 5

Figure 14:
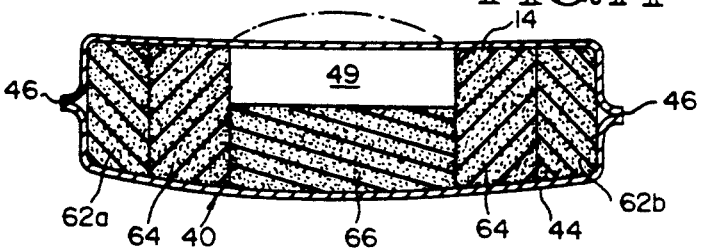
FIG. 14 is a cross sectional view, similar to FIG. 4, with a section of foam material removed to create a void having an IFD value near zero.

In some applications it may be desired to have IFD zones approximately equal to zero. These zones would support a load placed thereon almost exclusively by fluid floatation. Such zones would be most desirable in areas that must support very sensitive tissue. FIG 14 illustrates that such zones may be created by removing areas of foam from cushion 20 to create a void 49 and not bonding any foam element there beneath to membrane 42. As with any embodiment wherein membrane 42 is not bonded to foam elements there beneath, active pressurization of cushion 20 is not advised as such an area would bulge upwardly above void 49, as shown in phantom, upon increasing internal pressure without a load placed over the zero IFD zone.

The inventor has recognized that the present invention relates equally well to uses such as a bedding cushion, standard chair seat cushion, automobile seat cushion, or in packaging applications. The focus of the invention is on supporting a load by redistributing forces to areas more capable of supporting the load by incorporating one or more resilient elements, horizontally disposed from each other within a sealable, fluid impervious membrane, to form a cushion having multiple IFD zones. Therefore, the invention is to be identified by the following claims and not by the foregoing descriptions of the various embodiments.

What is claimed is:

1. A cushion to support a load having a generally planar bottom surface and a generally planar upper surface, bounded by an exterior peripheral surface having a generally uniform height comprising:

a plurality of resilient elements, horizontally disposed relative to one another and generally defining the shape of said cushion wherein each said resilient element has one surface corresponding to a portion of said bottom surface and one surface corresponding to a portion of said upper surface;

a fluid impervious membrane wholly surrounding said plurality of resilient elements, thereby forming a fluid impervious envelope having an interior; and a valve associated with said membrane and located intermediate said interior of said envelope and an external environment whereby said valve regulates fluid flow between said interior of said envelope and said external environment.

2. The cushion of claim 1 wherein each of said plurality of resilient elements has a known IFD value selected to be generally inversely proportional to an anticipated load associated with element's location, and placed within said envelope to accept and redistribute pressure forces created by said load.

3. The cushion of claim 1 wherein said membrane comprises two portions, said portions being sealingly bonded to one another about said resilient elements to form said envelope.

4. The cushion of claim 1 further comprising a pump coupled to said valve to actively pressurize said cushion.

5. The cushion of claim 1 wherein at least some of said plurality of resilient elements are bonded to said membrane over at least a portion of an inner surface of said membrane.

6. The cushion of claim 1 wherein said plurality of resilient elements are selectively bonded to said membrane to alter transition zone properties between said resilient elements.

7. The cushion of claim 1 wherein said membrane is constructed from stretchable material.

8. The cushion of claim 1 wherein at least two of said plurality of resilient elements are frictionally attached to one another.

9. The cushion of claim 1 wherein at least two of said plurality of resilient members are bonded to one another.

10. The cushion of claim 1 wherein said membrane is formed to fit said resilient elements so as to locate excess membrane material at said periphery, whereby said excess membrane material can migrate towards said upper surface when a load is placed on said cushion.

11. The cushion of claim 1 wherein said envelope permits said resilient members to achieve substantially full expansion when said cushion is not loaded.

12. The cushion of claim 1 wherein said periphery of said cushion is substantially uncompressed when said cushion is not loaded.

13. The cushion of claim 1 wherein said membrane is constructed from a durable and water repellant material.

14. The cushion of claim 1 wherein said cushion has a void defined by an upper portion of said cushion, said void having an IFD value approximately equal to zero.

15. A cushion to support a load comprising:

a plurality of resilient elements, horizontally disposed relative to one another;

a fluid impervious membrane wholly surrounding said plurality of resilient elements to form a fluid impervious envelope having an interior, said membrane having an upper portion and a lower portion sealingly connected to one another and being selectively bonded to said resilient elements to alter transition zone properties between said resilient elements; and a valve located at said membrane to permit ingress and egress of fluid between an environment and said interior of said envelope.

* * * * *